United States Patent [19]

Stevens et al.

[11] 4,145,997

[45] Mar. 27, 1979

[54] FURNACE ENCLOSURE FOR VAPOR GENERATOR

[75] Inventors: William D. Stevens, North Caldwell; Clarence C. Eich, Mountain Lakes; Harry H. Pratt, West Orange, all of N.J.

[73] Assignee: Foster Wheeler Energy Corporation, Livingston, N.J.

[21] Appl. No.: 862,786

[22] Filed: Dec. 21, 1977

[51] Int. Cl.[2] ..... F22B 37/24; F22B 37/36

[52] U.S. Cl. ..... 122/494; 122/510

[58] Field of Search ..... 122/6 A, 235 A, 494, 122/510

[56] References Cited

U.S. PATENT DOCUMENTS

| | | | |
|---|---|---|---|
| 3,364,905 | 1/1968 | Jordan | 122/494 |
| 3,592,171 | 7/1971 | Bernstein | 122/494 |
| 3,793,991 | 2/1974 | Round et al. | 122/494 |
| 3,799,123 | 3/1974 | Reale et al. | 122/494 |
| 3,850,149 | 11/1974 | Piaskowski | 122/494 |

*Primary Examiner*—Kenneth W. Sprague

*Attorney, Agent, or Firm*—Marvin A. Naigur; John E. Wilson; John J. Herguth, Jr.

[57] ABSTRACT

A furnace enclosure is provided in which one wall includes tubes of different passes which are free to move longitudinally relative to each other. A seal plate and filler means are disposed outside of the enclosure to provide for gas-tightness.

10 Claims, 6 Drawing Figures

FIG. 3
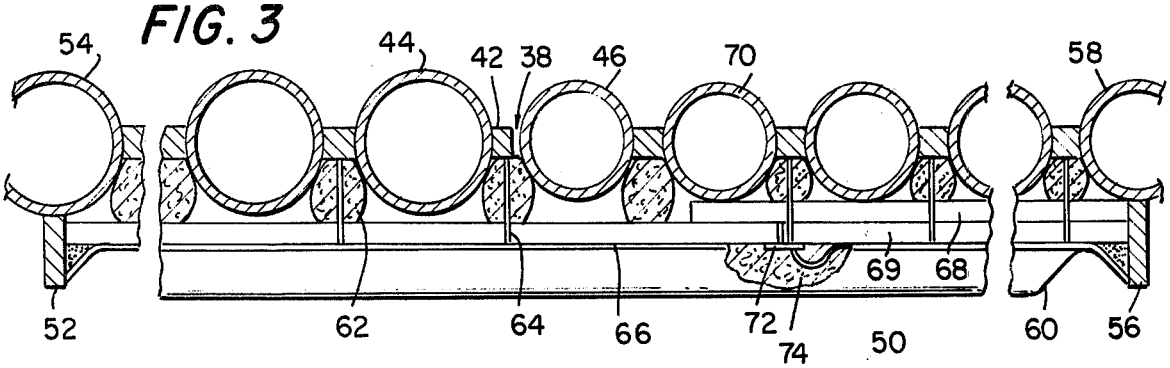
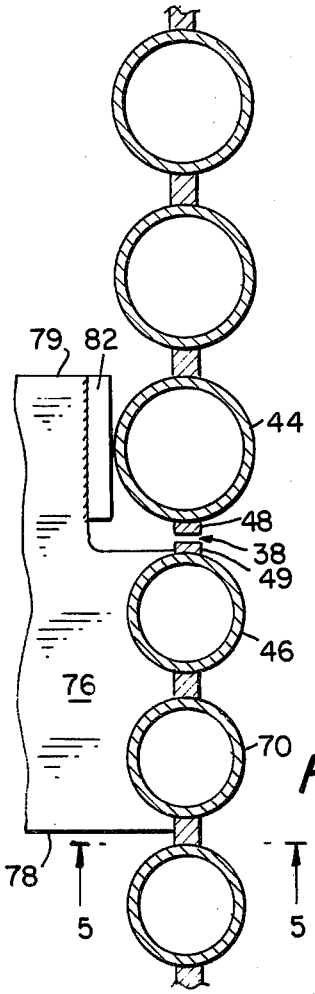
FIG. 4
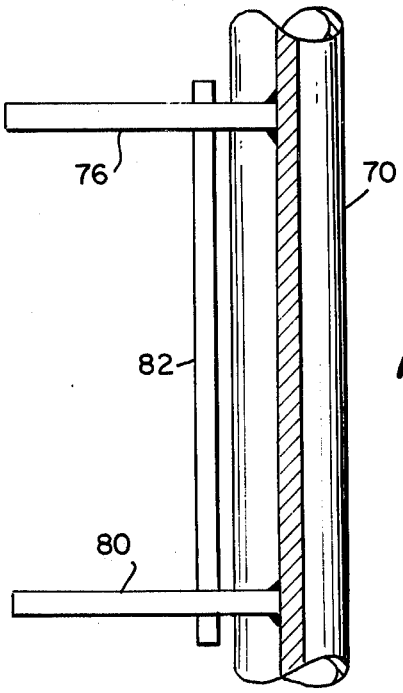
FIG. 5
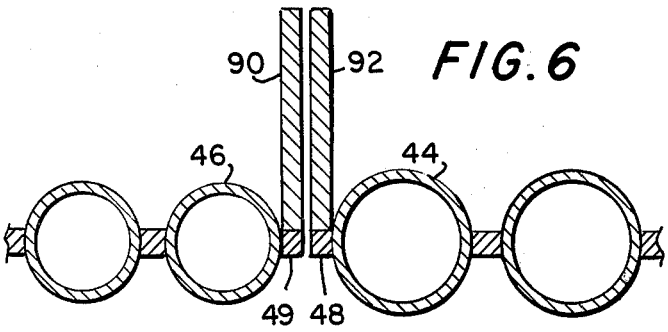
FIG. 6
FURNACE SIDE

FURNACE ENCLOSURE FOR VAPOR GENERATOR

BACKGROUND OF THE INVENTION

This invention relates to an enclosure through which hot gases are passed, and in particular, to such an enclosure for use in furnace sections of once-through vapor generators.

In general the furnace enclosure of a once-through vapor generator is made up of a plurality of walls defined by upright tubes arranged for the through-flow of a vaporizable fluid such as water. It is known to connect the wall forming tubes to each other by metal fins, thereby providing an all-welded gas-tight furnace enclosure.

In some furnace enclosure arrangements the wall tubes are grouped into several individual "passes" which are interconnected for serial flow of fluid. When the passes are disposed around the enclosure in a side-by-side manner, the fin connecting the edge tube of one pass to the adjacent edge tube of another pass can be subjected to high shear stresses, since the passes and tubes thereof experience different thermal expansion as a result of the absorption of heat from the hot gases passing through the furnace. Therefore, it has been proposed to eliminate the connecting fin between adjacent tubes of different passes, thereby spacing the passes apart and allowing the passes to move longitudinally relative to each other. It has also been proposed to connect a skin casing or seal plate to the adjacent passes in order to make the furnace enclosure gas-tight. A variety of seal plate designs have been proposed for use with such an arrangement. Some seal plates consist of metal sheets formed of a plurality of rhomboid shaped parallelogram areas, others consist of plates formed of a plurality of cup-shaped elements, and still others consist of a trough-shaped member having corrugations formed therein. Each of these seal plate arrangements is intended to compensate for the differential expansion which could occur between the adjacent passes of the enclosure.

However, an enclosure defined by spaced apart passes and provided with a skin casing or seal plate for gas-tightness could succumb to a problem known as "stack effect" whereby hot gasses passing through the enclosure flow into the space existing between the enclosure wall forming tubes and the skin casing or seal plate. The hot gases can rise up through that space, and heat the casing or seal plate, thereby causing it to fail. It has been proposed to provide overlapping fins between the adjacent tubes of different passes, in order to protect the seal plate from the direct in-flow of heated gases, but such a design would not be gas-tight at the overlap and hence would not preclude stack effect if hot gases did leak into the space between the seal plate and the wall.

In yet another enclosure design it has been proposed to use a slip joint consisting of three fins stuffed with asbestos rope and covered by skin casing. This arrangement would also not preclude stack effect, if leakage occured.

The instant invention provides a substantially gas-tight enclosure through which hot gases are passed, including a seal plate which compensates for differential expansion between adjacent passes of the enclosure, and means for filling the space between the wall and the seal plate which prevent overheating of the seal plate.

SUMMARY OF THE INVENTION

In accordance with an illustrative embodiment demonstrating features and advantages of the present invention, an enclosure through which hot gases are passed is provided which includes a plurality of upright walls formed from several tubes arranged in first and second fluid flow passes, with one of the walls including tubes of the first fluid flow pass and tubes of the second fluid flow pass. A corrugated seal plate is disposed behind and spaced apart from the one wall, extending behind some first pass tubes and behind some second pass tubes. The seal plate is connected along its longitudinal edges to the one wall. Filler means are disposed between the seal plate and one wall to substantially fill the space therebetween. The seal plate compensates for differential expansion of the adjacent passes, while the filler means prevent hot gasses from rising through the space between the seal plate and the enclosure wall, thereby preventing against overheating of the seal plate.

BRIEF DESCRIPTION OF THE DRAWINGS

The above brief description, as well as further objects, features and advantages of the present invention will be more fully appreciated by reference to the following detailed description of a presently preferred but nonetheless illustrative embodiment in accordance with the present invention when taken in connection with the accompanying drawings, wherein

FIG. 3 is a sectional view of the front wall of the vapor generator shown in FIG. 1 taken along line 3—3 of FIG. 1 showing details of the seal plate and filler means of the instant invention; j FIG. 4 is a sectional view taken along line 4—4 of FIG. 1 showing a finger bar and bumper plate of the instant invention;

FIG. 5 is a sectional view taken along line 5—5 of FIG. 4 showing the finger bars and bumper plate of the instant invention; and FIG. 6 is a sectional view taken along line 6—6 of FIG. 1 showing the means for minimizing the flow of preheated air from the windbox into the hopper of the furnace section of the vapor generator of FIG. 1.

DESCRIPTION OF THE PREFERRED EMBODIMENTS

Figure 1:
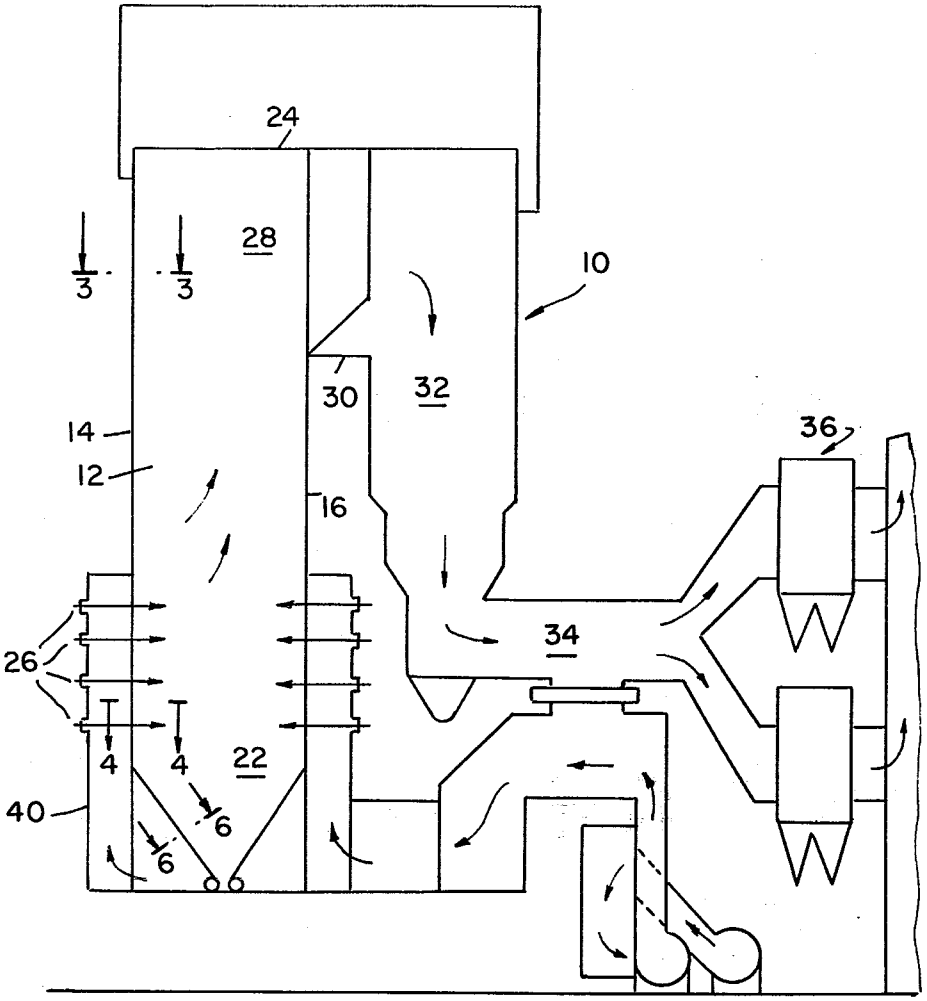
FIG. 1 is an elevational schematic view of a vapor generator incorporating the instant invention.

Referring to FIG. 1 of the drawings, a vapor generator incorporating the present invention is indicated by reference number 10. The vapor generator 10 includes a vertically extending rectangular upright furnace enclosure 12 in accordance with the instant invention. The enclosure 12 is defined by front wall 14, rear wall 16, and side walls 18 and 20, only side wall 18 being shown in FIG. 1 for the sake of convenience. The front, rear, and side walls are made up of panels of finned tubes extending vertically from a lower hopper section 22 to a roof 24. A fuel/air mixture is burned in burners 26 disposed in front wall 14 and rear wall 16, thereby yielding hot gases which are designated by arrows, which flow upwardly in the furnace enclosure 12. The gases leave the furnace enclosure 12 through a gas exit 28, flow across a vestibule section 30, and then flow downwardly through a convection section 32 to the vapor generator outlet 34. Thereafter the gases flow to a conventional air heater 36.

Figure 2:
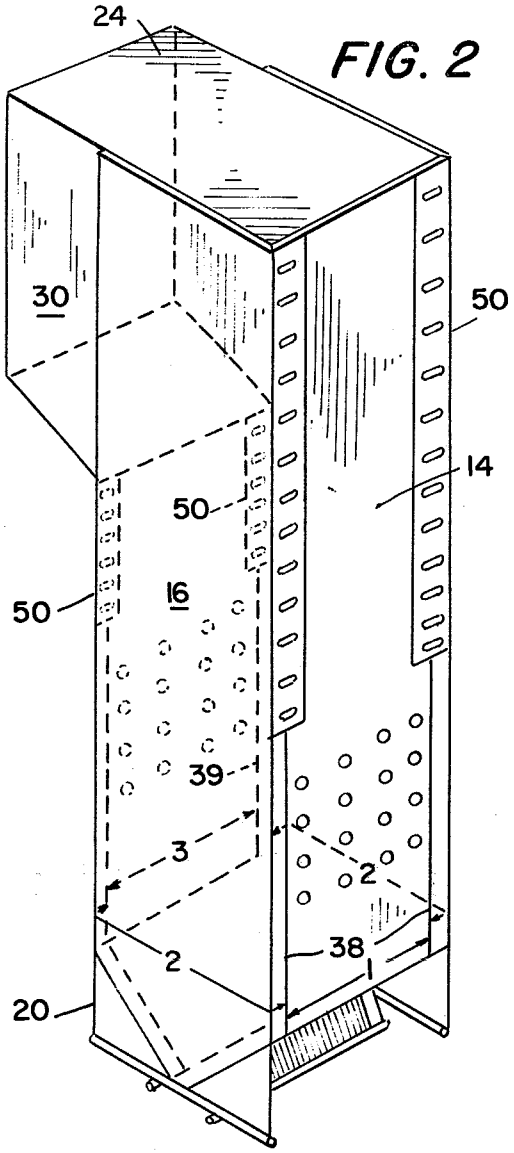
FIG. 2 is a perspective schematic view of the furnace enclosure portion of the vapor generator of FIG. 1 showing the seal plates of the instant invention.

A vaporizable fluid, such as water, is passed through the tubes forming the furnace enclosure walls 14, 16, 18, and 20, and absorbs heat given off by the hot gases, thereby changing the water into steam as it passes through the tubes forming the furnace enclosure 12. As better shown in FIG. 2, the furnace enclosure 12 is comprised of tube panels defining three upflow passes. The central group of tubes of front wall 14 comprises the first of the upflow passes, which are arranged for parallel flow of fluid and designated by the reference number 1. The side walls 18 and 20, together with wrap around portions of the front wall 14 and rear wall 16, comprise the second upflow pass, being arranged for parallel flow of fluid and designated by the reference number 2. The central group of tubes of rear wall 16 comprise the third upflow pass, being arranged for parallel flow of fluid and designated by the reference number 3. Therefore, the front wall 14 and the rear wall 16 each include tubes of two different upflow passes; the front wall 14 includes first pass tubes and second pass tubes, while the rear wall 16 includes second pass tubes and third pass tubes.

Adjacent furnace enclosure wall tubes are connected by metal fins around the periphery of the enclosure 12, except at locations where tubes of different passes are adjacent one another. In the front wall 14 at two locations where a first pass tube is adjacent a second pass tube, gaps exist which are designated by the lines 38, with the tubes on either side of the gaps being free to move longitudinally relative to one another. Similarly, in the rear wall at two locations where a second pass tube is adjacent a third pass tube, a gap 39 exists between adjacent second and third pass tubes.

The preferred embodiment of the invention includes furnace enclosure wall tubes which change diameter at an elevation between the hopper section 22 and roof 24. At approximately the elevation of the top of the windbox 40, the furnace enclosure wall tubes change outside diameter, being of a larger outside diameter in the upper furnace than in the lower furnace. As shown in FIG. 3, in the upper furnace, a fin 42 is disposed between the adjacent first and second pass tubes 44, 46 respectively, and is attached only to the first pass tube 44. In the lower furnace, as shown in FIG. 4, a split fin arrangement is provided, which includes fin sections 48, 49 attached to the adjacent first and second pass tubes 44, 46, but not attached to each other. It is to be understood that either of these intermediate fin arrangements could be used throughout the height of the furnace enclosure wall; the particular combination shown in merely a preferred arrangement. Since the seal arrangement associated with each gap 38 is substantially similar, only one will be hereinafter discussed.

As shown in FIG. 3, a corrugated seal plate 50 extends generally parallel to the front wall and across the outside surfaces of first pass tubes and second pass tubes on either side of the gap 38. Along one longitudinal edge of the seal plate 50 a vertical bar 52 is connected between the outside surface of a first pass tube 54 and the edge of the seal plate 50. Along the other longitudinal edge of the seal plate 50 a second bar 56 is connected between the outside surface of a tube 58 of the second pass and the other edge of the seal plate 50. It is to be understood that the bars 52, 56 could be connected between the seal plate edges and fins connected between the wall tubes. The corrugations 60 formed in the seal plate 50 extend perpendicular to the longitudinal axes of the furnace enclosure wall tubes, and are arranged to allow for expansion and relative longitudinal movement between adjacent first and relative longitudinal movement between adjacent first and second pass tubes. It is to be understood that in the rear wall 16, seal plates are disposed outside of the furnace enclosure and behind the outside surfaces of adjacent second and third pass tubes between which gaps 39 are located in a similar manner.

The space between the corrugated seal plate 50 and the outside surfaces of the furnace enclosure wall behind which the seal plate 50 extends is partially filled by strips of asbestos rope 62 which extend from approximately the top of the front wall 14 down to approximately the top of the windbox 40. The strips of rope 62 are impaled over metal pins 64 which are attached to the fins connected between the tubes behind which the seal plate 40 extends. The pins 64 are arranged in rows at various elevations between the top of the windbox 40 and the top of the front wall 14, with the number of rows being sufficient to maintain the rope positioned between adjacent tubes. Sections of insulation board 66 are laid transversely across the outside surfaces of the front wall first pass tubes and some of the adjacent second pass tubes behind which the seal plate 50 extends after the ropes 62 have been installed. Similar insulation board sections 68 are laid across the outside surfaces of some second pass tubes, behind which seal plate 50 extends, with the edges of sections 68 overlapping adjacent edges of sections 66. It will be noted that the pins 64 have been omitted from between two second pass tubes, 46, 70, in order to allow for relative movement, or slippage, between the insulation board sections 66, which are fastened to first pass tubes, and the second pass tubes. In the particular embodiment disclosed, front wall tubes of the second pass are of a smaller diameter than front wall first pass tubes. Consequently, a second layer of insulation board 69 is employed between the smaller tubes and the corrugated seal plate 50 in order to better fill the space therebetween. Sections 66, and similarly sections 68, 69 are laid one above another from approximately the top of the windbox 40 to approximately the top of the front wall 14, and are impaled over the pins 64 thereby being held in position between the front wall tubes and the seal plate 50. Speed clip washers 72 are installed over each pin 64 and thereafter the pins 64 are bent flush with the outside surface of the insulation board sections. The corrugations 60 of the seal plate 50 are filled with plastic insulating cement 74 and the inside surface of seal plate 50 is covered with plastic cement before the seal plate 50 is positioned over the insulation board sections 66, 68 to provide additional filler material in the remaining space between the seal plate 50 and the furnace front wall tubes. This arrangement provides a substantially gas-tight seal at the location of adjacent first and second pass tubes, with the corrugated seal plate 50 allowing for relative movement between tubes of the first pass and tubes of the second pass. Furthermore, the filler means prevent hot gases from entering into the space between the seal plate 50 and tubes of the furnace enclosure front wall 14. By so doing, the seal arrangement prevents the seal plate 50 from being exposed to the hot gases which rise in the furnace enclosure 12, and thereby precludes overheating and consequent damaging of the seal plate 50. It is to be understood that while the above discussion is directed to adjacent first and second pass tubes of the front wall 14, a substantially similar construction is provided in the rear wall 16 at each location where a second pass tube is adjacent a third pass tube.

In FIG. 4 means for maintaining front wall first pass tubes and second pass tubes in the same general vertical plane are shown. An L-shaped finger bar 76 is provided which has a first leg 78 welded to second pass tubes 46, 70 adjacent gap 38. Another leg 79 of the L-shaped finger bar 76 extends behind tube 44 of the first pass on the other side of gap 38. As shown in FIG. 5, a second L-shaped bar 80 is disposed below the L-shaped bar 76 and is similarly attached to tubes 46, 70. A bumper bar 82 is attached to respective second legs of the upper L-shaped bar 76 and the lower L-shaped bar 80 and lies between bars 76, 80 and first pass tube 44. Bars 76 and 80 together with bumper bar 82 act to prevent the second pass tubes from moving into the furnace enclosure 12, out of the plane defined by the furnace front wall 14. Outward movement of front wall tubes is precluded by a conventional buckstay system, which is not shown.

Since the vapor generator is top supported, the expansion of upright wall forming tubes results in downward growth of the enclosure. Consider the front wall sloping tubes. Because second pass tubes will expand at a different rate than first pass tubes, the gap 38 between adjacent first and second pass hopper tubes tends to increase in size as the tubes become misaligned. Referring to FIG. 6, at the location where a first pass tube 44 is adjacent a second pass tube 46 in the hopper section 22, fins 48, 49 are attached to respective first and second pass tubes 44, 46. Bars 90, 92 are attached to fins 48, 49 and extend perpendicular to the plane defined by the sloped section of the furnace front wall 14. If either first pass or second pass tubes move further than the other tubes, the bars 90, 92 compensate for the difference in outward movement and prevent gap 38 from being enlarged. Therefore, after preheated air is passed from air preheater 36 into windbox 40, the amount of preheated air which can flow through gap 38 formed in the sloped portion of front wall 14 is minimized. When it can be anticipated that tubes of one pass will move outwardly further than tubes of the other pass, one of the bars 90, 92 can be eliminated, since the remaining bar will act as an extension of the fin to which it is attached, thereby maintaining the approximate size of the gap 38. For example, if it is anticipated that the second pass tubes will move further out of the plane defined by the sloped portion of the front wall than the first pass tubes, then bar 92 associated with fin 88 can be eliminated. Again, while the above description is directed to the construction of the front wall 14, it is to be understood that a similar construction is to be utilized in the furnace enclosure rear wall sloped portion, which together with the sloped portion of the furnace enclosure front wall defines the hopper section 22.

In operation, a vaporizable fluid, such as water, is passed through first, second, and then through third fluid flow pass tubes which define the furnace enclosure 12, while a fuel/air mixture is burned in the burners 26. Hot gases rise within the furnace enclosure 12, and give off heat to the furnace wall tubes, which is absorbed by the fluid passing therethrough. During some periods of operation, fluid passing through second pass tubes will have absorbed a different amount of heat than fluid passing through first pass tubes. As a result, the tubes 1 of the first pass may expand to a different extent than tubes 2 of the second pass. The seal plate 50 allows for differential growth of adjacent first and second pass tubes since its corrugations are arranged to compensate for the differential expansion, while providing a gas-tight seal at the location of gaps 38 between first and second pass tubes. Similarly, second and third pass tubes of the rear wall 16 may experience differential expansion which is compensated for by seal plates associated with adjacent second and third pass tubes of the rear wall. Filler means disposed between the various seal plates 50 and furnace enclosure wall tubes prevent hot gases from rising up through the spaces between the seal plates and tubes, and thereby prevent against overheating the seal plates. If front wall second pass tubes tend to move inwardly of the furnace, the L-shaped bars 76, 80 and bumper bar 82 engage tubes of the second pass and keep them from moving out of the plane of the front wall. Similar L-shaped bars and bumper bars prevent second pass tubes of the rear wall from moving inwardly of the furnace. If the sloped portions of the front and rear wall 14, 16 forming the hopper section 22 move out of alignment at the location of the gap between adjacent first and second, or second and third pass tubes, the flow of preheated air from the windbox through the gaps in the sloped walls is minimized by the bars 90, 92 attached to intermediate fins which are connected to the adjacent tubes of different passes.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An enclosure through which hot gases are passed comprising (a) upright walls defined by a plurality of tubes for passing a vaporizable fluid therethrough, said tubes being arranged in first and second fluid flow passes, one of said walls including first and second pass tubes, said first pass tubes being spaced apart from said second pass tubes and adapted to move longitudinally relative to said second pass tubes, adjacent first tubes being connected to each other by metal fins, adjacent second pass tubes being connected to each other by metal fins, (b) a corrugated seal plate disposed behind and spaced apart from the outside surface of said one wall, a first portion of said seal plate extending behind tubes of said first pass, a second portion of said seal plate extending behind tubes of said second pass, corrugations of said seal plate extending substantially perpendicular to the axes of said tubes, said plate being spaced apart from said one wall and lying in a plane generally parallel thereto, (c) means for connecting said plate to said one wall, and (d) means disposed between said plate and said one wall for substantially filling the space between said one wall and said plate.

2. The enclosure of claim 1 wherein said means for connecting said plate to said one wall include a plurality of metal bars, one of said bars being connected between said one wall and a first longitudinal edge of said plate, another of said bars connected between said one wall and the other longitudinal edge of said plate.

3. The enclosure of claim 1 in which said means disposed between said plate and said one wall comprise a plurality of strips of ceramic rope disposed between adjacent wall tubes, a plurality of sheets of insulation board extending laterally between said wall and said plate, means for attaching said strips of rope and said sheets to said wall, and insulating cement disposed in said corrugations formed in said seal plate.

4. The enclosure of claim 1, wherein said enclosure comprises a vapor generator furnace, further including a windbox extending across the lower portion of said furnace and adapted to provide preheated air for combustion with a fuel in said furnace, said seal plate extending from the top of said windbox to the top of said furnace.

5. The enclosure of claim 4 wherein said walls comprise front, rear and a pair of side walls, said windbox extending across a lower portion of said front wall, said seal plate extending from the top of said windbox to the top of said front wall.

6. The enclosure of claim 5 wherein said front and rear walls are sloped inwardly defining a hopper adjacent the bottom of said furnace, and further comprising means for minimizing leakage of said preheated air from said windbox through said spaced apart first and second pass tubes of said hopper into said furnace.

7. The enclosure of claim 6 wherein said walls further include tubes arranged in a third fluid flow pass, said rear wall comprising tubes of said second pass and tubes of said third pass, said second pass tubes being spaced apart from said third pass tubes and adapted to move longitudinally relative to said third pass tubes.

8. The enclosure of claim 7 wherein said windbox extends across a lower portion of said rear wall, and further comprising an additional corrugated seal plate disposed behind and spaced apart from said rear wall, a first portion of said additional seal plate extending behind tubes of said second pass, a second portion of said additional plate extending behind tubes of said third pass, means for connecting said additional plate to said rear wall, and means disposed between said additional plate and said rear wall for substantially filling the space between said additional plate and said rear wall.

9. The enclosure of claim 5 further comprising means for maintaining said first pass tubes and said second pass tubes in the same general vertical plane.

10. The enclosure of claim 9 wherein said means for maintaining said tubes in the same general vertical plane comprise a plurality of L-shaped bars, one leg of each bar being attached to the outside surface of one tube of one of said passes, the other leg of each bar extending behind the outside surface of one tube of the other of said passes, said L-shaped bars being disposed one above another, and a vertically extending bar disposed between the outside surface of said tube of said other pass and being attached to said other leg of at least one of said L-shaped bars.

* * * * *